US005169265A

United States Patent [19]

Butler et al.

[11] Patent Number: 5,169,265

[45] Date of Patent: Dec. 8, 1992

[54] PASSIVE FIRE PROTECTION SYSTEM FOR MARINE RISERS

[75] Inventors: Bryan V. Butler, Irvine, Calif.; John D. Koos, The Woodlands, Tex.

[73] Assignee: Paul-Munroe Hydraulics, Inc., Orange, Calif.

[21] Appl. No.: 767,025

[22] Filed: Sep. 27, 1991

[51] Int. Cl.[5] ..... E21B 43/01

[52] U.S. Cl. ..... 405/224.4; 166/367; 405/211

[58] Field of Search ..... 405/63, 157, 169, 195.1, 405/211, 216, 224.2, 224.3, 224.4; 166/350, 359, 364, 367

[56] References Cited

U.S. PATENT DOCUMENTS

| | | | |
|---|---|---|---|
| 4,619,553 | 10/1986 | Fischer | 405/63 |
| 4,634,314 | 1/1987 | Pierce | 405/224.2 |
| 4,733,991 | 3/1988 | Myers | 405/224.2 |
| 4,770,563 | 9/1988 | Pido | 405/169 |
| 4,821,804 | 4/1989 | Pierce | 166/367 |
| 4,883,387 | 11/1989 | Myers et al. | 405/224.4 |
| 4,923,332 | 5/1990 | Sanocki et al. | 405/63 |

*Primary Examiner*—David H. Corbin
*Attorney, Agent, or Firm*—Joseph R. Dwyer

[57] ABSTRACT

A fire protection system comprising a plurality of insulation protective jackets placed around the top joint of a riser string above and below the tensioner ring and its protective cover and over the threads or annular protrusions used to facilitate the connection of the tensioner ring to the top joint. Each protective jacket comprises an outer section of multiple layers of cloth, the outer layer being of an abrasive resistant, weather resistant material, and at least one of these layers being a woven ceramic fiber that helps to eliminate flame impingement, one or more layers of reinforcement (as many as required) and an inner section composed of a thick interior multi-layered composite layer of ceramic fibrous material and barrier films and an inner abrasion resistant liner to minimize heat transfer and gas passage to the protective part. Each protective jacket overlaps an adjacent protective jacket and the number of protective jackets above and below the tensioner ring and its protective cover depends upon the position of the tensioner ring on the threads or annular protrusions on the top joint and the top and bottom protective jackets are formed to cooperate with the intumescent epoxy on the non-threaded portion of the top joint. Each protective jacket is also preferably laced to its adjacent jacket and preferably secured by suitable straps to seal the covered area against flame and heat intrusion.

The protective jackets may also be used to cover an entire top joint eliminating the need for intumescent epoxy and may be used to cover all or any part of a riser section.

13 Claims, 4 Drawing Sheets

PASSIVE FIRE PROTECTION SYSTEM FOR MARINE RISERS

BACKGROUND OF THE INVENTION

In a related application entitled "Passive Fire Protection System for Articulating Joints & Flexible Connections", U.S. Pat. No. 07/695,296 filed May 3, 1991 of John D. Koos and Alan Ester, there is disclosed and claimed a fire protection system for the protection of articulating joints and flexible connections for a marine riser system of an offshore oil or gas rig.

The purpose of this invention is also to provide a fire protection system against flame and heat for other parts of a marine riser tensioner system of an offshore oil or gas rig.

More specifically, this invention provides fire protection for the top riser section, called a top joint or adjustable top joint, of a string of risers which has means for facilitating the connection of a riser tensioner ring to the top joint and provides fire protection for all risers which are fully or partially unprotected.

This invention will be first described in connection with the adjustable top joint and then the protection of other risers will be described.

In a marine riser system, a string of riser sections extend from a well on the ocean floor to a platform wellhead through a hole in the platform of a rig located at the water surface. Riser tensioners, usually of the pneumatic hydraulic cylindrical type, are connected between the platform and the riser string to maintain the riser string in tension at all times regardless of the rise and fall of the rig due to wave motion. The rods of the tensioner cylinders are connected to the marine riser string by means of a riser tensioner ring.

In some of these riser tensioner systems, the top joint is provided with a means to facilitate the connection of the tensioner ring to the riser string. This means is in the form of external threads or annular protrusions over a portion of the length of the top joint. The U.S. Pat. No. 4,733,919 discloses one such top joint. Another type of top joint with threads or annular protrusions is disclosed herein in connection with this invention.

While the articulated joints, flexible connections and the tensioner ring of a marine riser tensioner system may be provided with fire protection, as disclosed in the above Related Application, and while the outer surfaces of the structural members of the system may be protected by a coating of intumescent epoxy for fire and flame protection, the threaded or protruded portion of the top joint has heretofore been left unprotected against flame and heat.

Therefore, it is an object of this invention to provide a fire protection system for the adjustable top joint of those marine riser tensioner systems having means for facilitating the connection of a riser tensioner ring to the riser string.

Too, while in some systems the riser sections normally above the water may be provided with a coating of intumescent epoxy, some risers are not so protected or may be protected over only a part of their length.

Still another object of this invention, therefore, is to provide a fire protection for all unprotected or partially unprotected riser sections of a marine riser tensioner system.

In the Related Application, the flame and heat protective covers used to cover the articulated joints, flexible connections and the rods of the tensioner cylinders are "customized" to the size and length of the structural members and the articulated joints. These protective covers are also pleated to protect the rods of the tensioner cylinders.

This invention, on the other hand, provides standardized prefabricated protective jackets to protect the unprotected part of the top joint and the unprotected parts of the other risers.

It is therefore still another object of this invention to provide the adjustable top joint and other risers with standardized prefabricated jackets to protect the top joint and to protect all or part of the marine risers of a marine riser tensioner system.

SUMMARY OF THE INVENTION

The fire protection system which meets the foregoing objects comprises prefabricated standardized jackets each of which comprises an outer section of multiple layers of cloth, the outer layer being of an abrasion resistant, weather resistant material and at least one of these layers being a woven ceramic fiber that helps to eliminate flame impingement, one or more layers of reinforcement (as many as required), and an inner section composed of a thick, interior multi-layered composite blanket of ceramic fibrous materials and barrier films and an inner abrasion resistant lining to minimize heat transfer and gas passage to the protected part. The outer section of the jackets facilitate handling. Nearly all of the protective jackets are equal in length and overlap, or nest in, adjacently positioned jackets to prevent flame and heat intrusion and the number of protective jackets depends on the length of the item to be protected.

In the case of the top joint, the protective jackets are placed around the top joint, above and below the tensioner ring and its protective cover, and over the threads or annular protrusions. The number of protective jackets above and below the tensioner ring and those protective jackets which contact the intumescent epoxy on the riser are formed to cooperate therewith.

In the case of the other risers, the number of protective jackets used will depend upon the length of the outside surface which is unprotected and the protective jackets are also formed to cooperate with intumescent epoxy on the riser section, if any.

If necessary, protective jackets of shorter lengths may be used if the set of standard protective jackets do not fit the length of the area being protected.

Each protective jacket is also preferably fastened by lacing or strapping of the same materials as the outer section layers to its adjacent protective jacket and preferably additionally secured by suitable circumferential straps also of the same material as the outer section layers to seal the covered area against flame and heat intrusion.

As will be apparent, the top joint and other risers may be fully protected against heat and flame by the use of these protective jackets thus eliminating the need for the intumescent epoxy resin, if desired.

DETAILED DESCRIPTION

Figures 1, 6, 7:
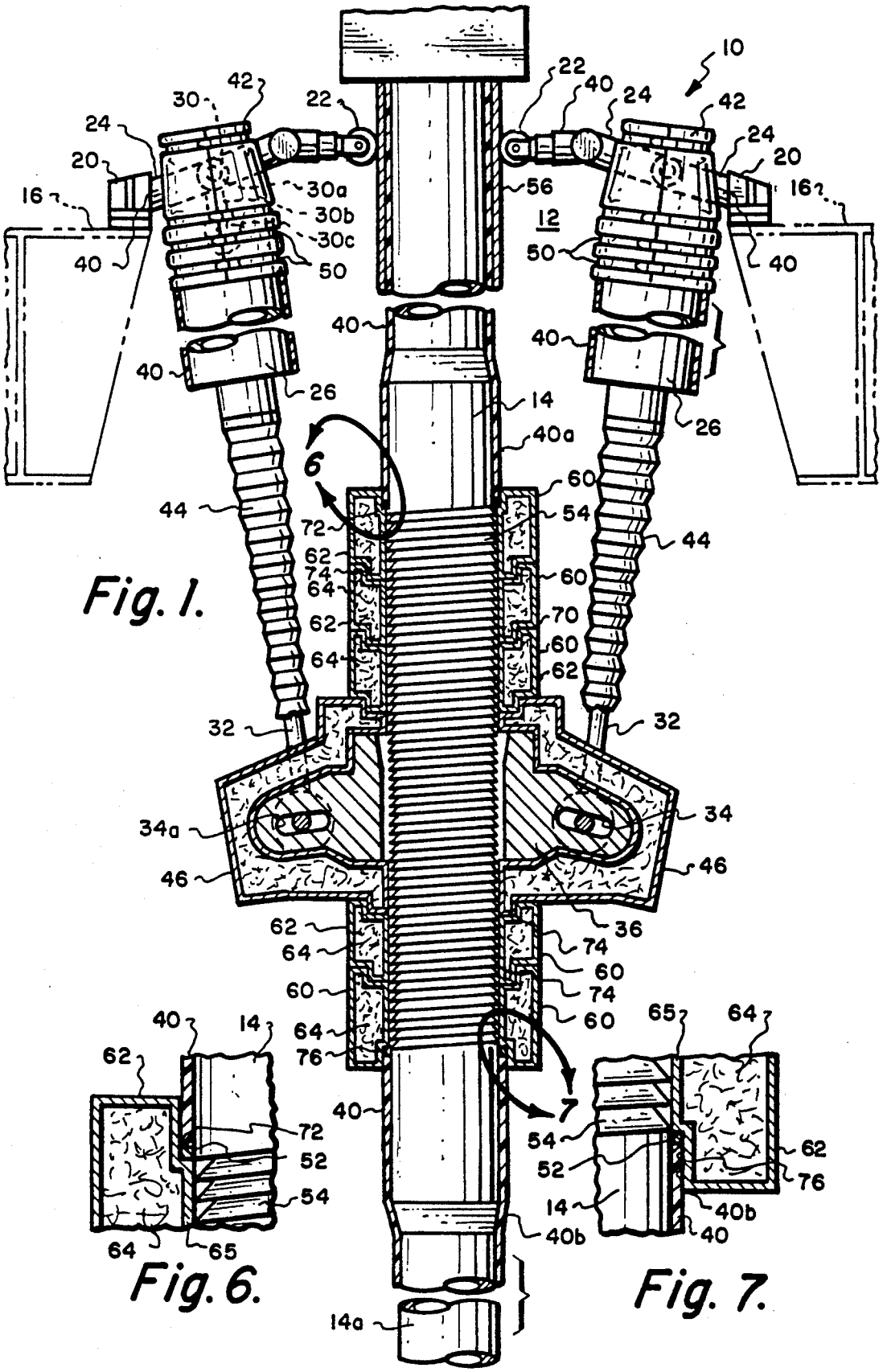
FIG. 1 is an elevational view of a marine riser tensioner system of an offshore rig illustrating the fire protection of a section of the riser (in this case the threads or annular protrusions of the top joint of the riser string) by the use of a number of protective jackets. This FIG. also shows the protection of the articulated joints and the tensioner ring against fire as disclosed in the Related Application.
Figure 2:
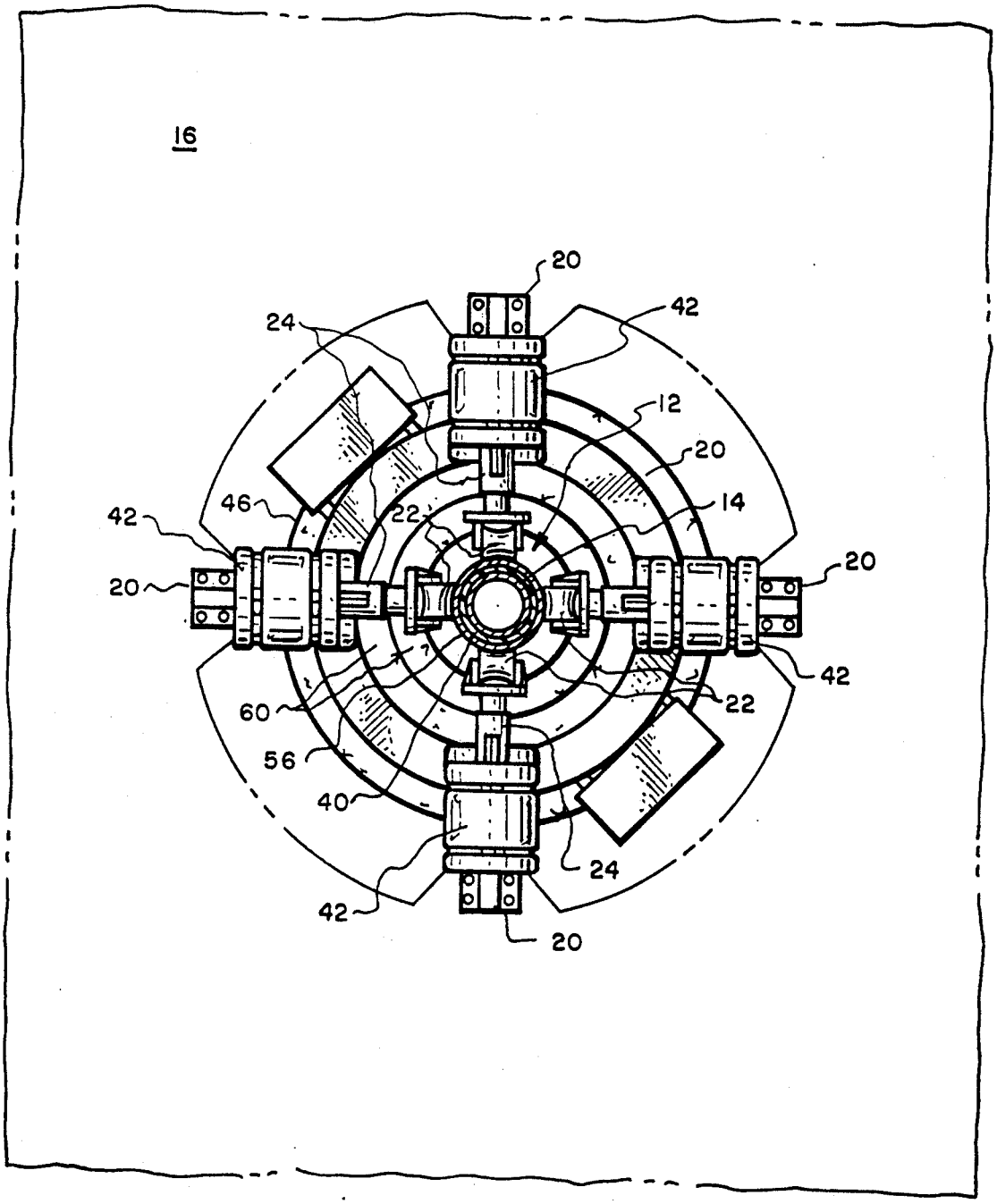
FIG. 2 is a top plan view of the riser tensioner system of FIG. 1.

FIGS. 1 and 2 illustrate a riser tensioner system 10 of the pneumatic-hydraulic type which extends through a hole 12 in a platform of an offshore rig to permit relative motion between a riser string and the platform. As shown, riser section 14 is the top joint of a string of riser sections which extend from the platform to a well in the ocean floor. Section 14*a* represents additional riser sections.

The riser tensioner system 10 is secured to a suitable support, such as I-beams 16 and a supporting ring 20 which encircles the top joint 14. Rollers 22 guide and center the top joint 14. The supporting ring 20 is spaced above and secured to the I-beams 16 by short structural members 24 to provide sufficient clearance for the pneumatic-hydraulic tensioner cylinders 26 (only two shown in FIG. 1). These cylinders 26 are connected to the structural members 24 by articulating joints 30, formed by pins 30*a*, eyebolts 30*b* and clevises 30*c*. Typically, the tensioner cylinders 26 are connected to the I-beams 16 and extend downwardly where their rods 32 are connected to the top joint 14 by articulating joints 34 typically formed by clevises and holes or slots 34*a* formed in a tensioner ring 36 secured to the top joint 14. Thus, during relative movement between the riser string and the platform, as a result of wave motion, the riser string is continually under tension as a function of the pneumatic-hydraulic cylinders 26.

Thus far described, the riser tensioner system 10 is conventional and shown in any number of patents and articles about offshore sub-sea drilling and production rigs and need not be described further.

Also as shown, the riser tensioner system 10 is fire protected by a coating of intumescent epoxy 40 on the tensioner cylinders 26 and other rigid members, such as the supporting ring 20, on the structural members 24 and multi-layer flexible covers over the articulating joints, such as 30 and 34. These covers are shown in the form of end caps 42, pleated protective covers 44 and a cover 46 over the tensioner ring 36 are more fully disclosed in the Related Application which is incorporated herein by reference. The pleating of the protective covers 44 allow extension and retraction of the rods 32 within the cylinders 26 to maintain the riser string under tension. (Part of the rods 32 are exposed in FIG. 1 simply for clarity).

FIGS. 1 and 2 also show suitable straps 50 to secure the end caps 42 around the articulated joints and over the cylinders 26. The number and position of these straps 50 will depend upon the size and configuration of the protective covers. While the structural members 24 and most of each of the cylinders 20 are covered with the intumescent epoxy 40, for further protection against heat and flame entrance at those places where the intumescent epoxy 40 ends and the protective cover overlap, a ceramic heat resistant compound 52 is suitably disposed on the end of the intumescent epoxy 40, as by caulking. This is more clearly shown in FIGS. 6 and 7 and this compound 52 expands when subjected to heat and flame and aids in the prevention of heat and flame beneath the protective covers for the protection of the covered members. This compound 52 is placed at any point in the system where the intumescent epoxy 40 ends as will be apparent hereinafter. This feature is also disclosed in the Related Application.

As also explained in the Related Application, the protective covers may be formed in any suitable manner to cover any articulating joint and any flexible connection as well as any exposed structural member which may be subjected to possible damage by heat and flame.

As mentioned above, in some marine riser systems, the top joint 14 is provided with threads or annular protrusion, such as threads 54 in FIG. 1, to aid in securing the tensioner ring 36 to the top joint 14. The threads 54 are located, in this embodiment of a top joint 14, near its mid-portion so that the tensioner ring 36 may be conveniently secured at a point on the top joint 14 where the stroke of the cylinder rod 32 is near the midpoint as determined by the expected up and down motion due to the waves. (Hereinafter, only threads 54 will be discussed but it is to be understood that annular protrusions are to be considered feasible in connection with this invention). Also, the manner in which the tensioner ring 36 is connected to the threads 54 is not material to this invention and will not be described in detail.

Heretofore, one way to protect the exposed metal of a top joint, such as 14, was to coat this exposed metal above and below the threads 54 with intumescent epoxy 40 leaving the threads 54 exposed and vulnerable to heat and flame damage. This invention provides protection for this heretofore exposed area and will be described in connection with the top joint which has an intumescent epoxy coating on the exposed metal above and below the threads 54. However, as mentioned above, it should be apparent that this invention can be used to protect the entire top joint thus eliminating the need for the intumescent epoxy coating and can be used to protect the entire or any part of any riser section or connecting joint.

Thus, FIG. 1 shows this intumescent epoxy 40 extending, as at 40*a*, from the top of the threads 54 to the top of the top joint 14 and from the bottom of the threads 54 to the lower end of the top joint 14, as at 40*b*, where the top joint 14 is connected to the next lower section of the riser string, such as 14*a*. Also, to protect the intumescent epoxy 40*a* from any damage that may be caused by the rollers 22, a metal sleeve 56 covers a portion of the intumescent epoxy 40*a*. The length of sleeve 56 depends on the amount of relative movement between the platform and the riser string.

Figure 3:
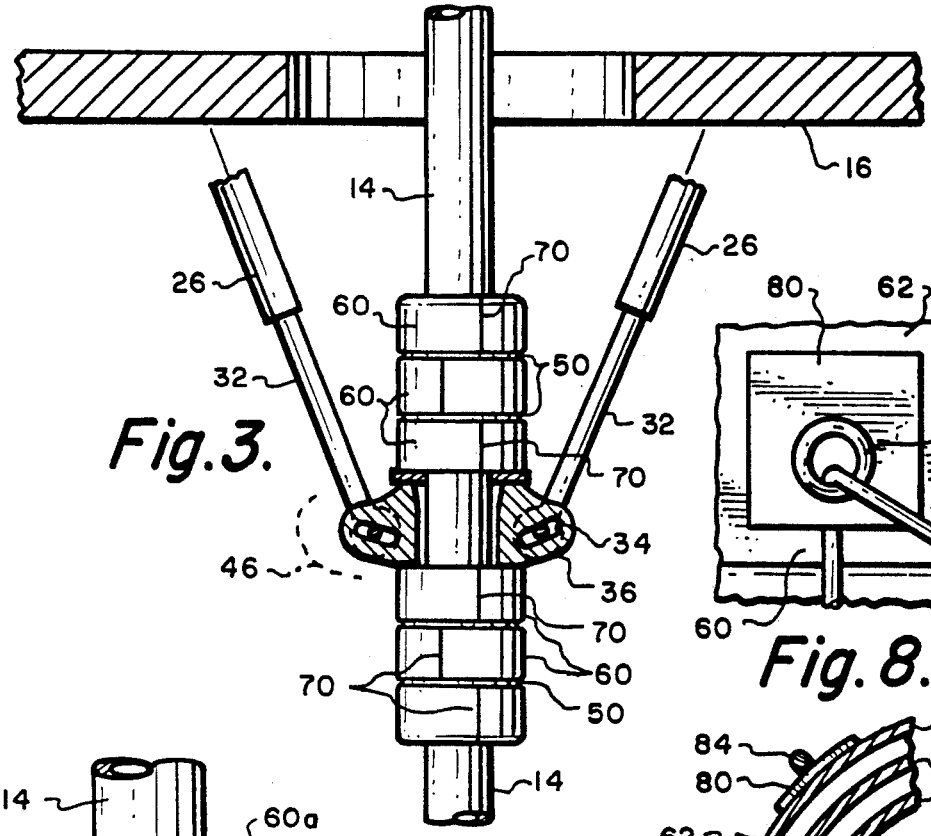
FIG. 3 is a schematic elevational view of a marine riser system such as in FIG. 1 but showing another distribution of the number of protective jackets.
Figure 8:
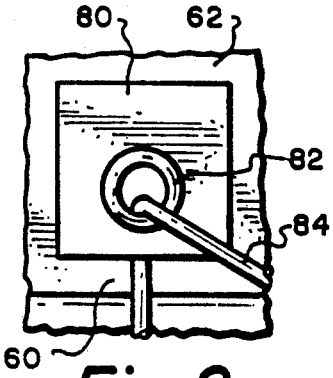
FIG. 8 is an enlarged view of the area encircled in FIG. 4 to show more clearly the sewn tabs and lacing of the protective jackets.
Figure 4:
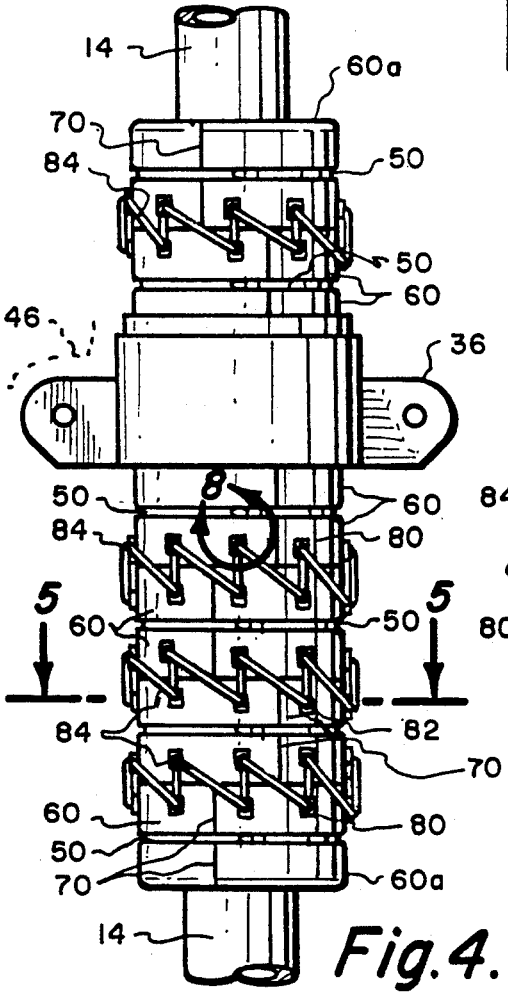
FIG. 4 is an elevational view of part of a top joint showing still another distribution of the protective jackets and the means for lacing the protective jackets to one another.
Figure 5:
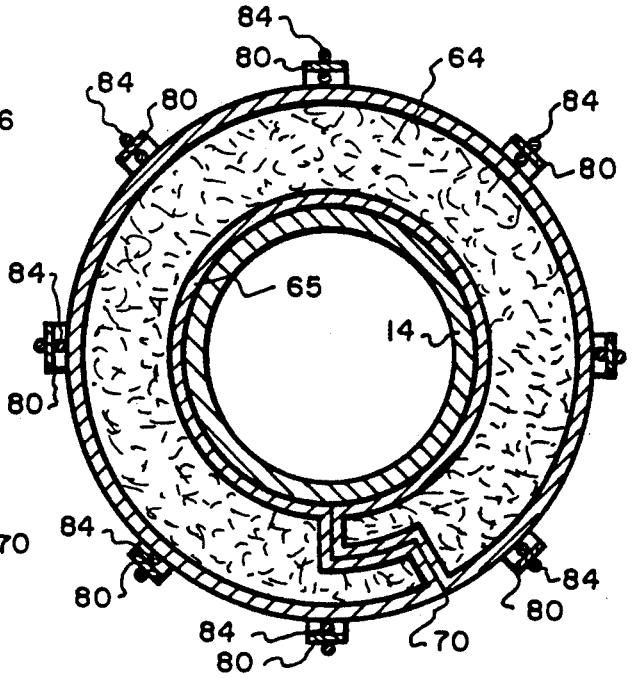
FIG. 5 is a cross-sectional view of one protective jacket taken along line 5—5 of FIG. 4, FIGS. 6 and 7 are enlarged views of the areas encircled in FIG. 1 to illustrate the interrelationship of the intumescent epoxy and protective jacket.

To protect the threads 54 from heat and flame, the top joint is provided with a plurality of protective jackets 60 as shown in FIGS. 1, 3 and 4. The lengths of the protective jackets 60 are preselected and their number depends upon the position of the tensioner ring 36 and its covering 46 on the threads 54 on the top joint 14. The length of each protective jacket is always less than the expected length of threads, either above or below the tensioner ring 36 and its covering 46, to allow standardization and prefabrication of the protective jackets, their mass production and storing rather than customizing a protective jacket for each length of exposed thread above and below the tensioner ring 36 and its covering 46. For example in FIG. 1, there are three protective jackets 60 of equal length above the tensioner ring 36 and its cover 46 and two protective jackets of the same equal length below the tensioner ring 36. FIG. 3 shows three protective jackets of equal length above and below the tensioner ring 36 and its cover 46 while FIG. 4 shows only two protective jackets 60 of equal length above the tensioner ring 36 and its cover 46 and four protective jackets 60 of the same equal length below the tensioner ring 36 and its cover 46. A short protective jacket 60*a* may be used to cover a short area of metal above the termination of the intumescent epoxy 40*b* depending upon the position of the tensioner ring on the threads 54 and, similarly, a short protective jacket 60*a* may also be used at the top of the protective jackets, if the exposed area is not completely covered by the selected number of the protective jackets.

Figure 9:
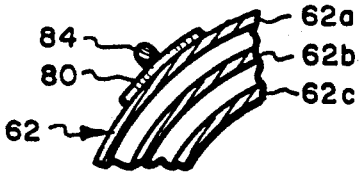
FIG. 9 shows part of a multi-layer outer protective covering for a protective jacket.

Referring to FIGS. 1 and 6–7, it can be seen that each protective jacket 60 comprises an outer section 62 of multiple layers of cloth, the outer layer being of an abrasion resistant, weather resistant material and at least one of these layers being of a woven ceramic fiber that helps to eliminate flame impingement, one or more layers of reinforcement (as may be required), and an inner section composed of a thick interior multi-layered composite blanket 64 of ceramic fibrous material and barrier films and an inner abrasion resistant lining 65 to minimize heat transfer and gas passage to the protected part. The outer section 62 facilitates handling of the jacket. The interior blanket 64 of composite ceramic fibrous materials and barrier films minimizes the transfer of heat to the threads 54. In the embodiment shown, the outer section 62 completely encloses the interior blanket 64 of material but the inner liner 65 may be separate. Also, it is pointed out that the outer section 62 and liner 65 are shown as a single layer in FIGS. 1 and 6–7 but this outer section is multi-layered as shown in FIG. 9 at 62*a*, 62*b* and 62*c*.

As disclosed in the Related Application, for a particular fire rating, the mass being protected, the height of the allowable temperature and the thickness of the protective covering (the outer section and amount of fibrous material and barrier films forming the interior blanket) can be adjusted according to the needs of the item being protected.

As shown in these figures, the protective jacket 60 is tubular and initially formed flat and then wrapped around the top joint. These protective jackets are completely enclosed by the outer section 62 with the longitudinal ends overlapped to form a stepped seam 70 to prevent heat and flame intrusion. The top of each protective jacket is also stepped to form an upwardly directed toroidal opening 72 to receive a complementary downwardly directed toroidal tongue 74 of an adjacent protective jacket to thus overlap an adjacent protective jacket 60. Thus, each protective jacket 60 will overlap, or nest within, an adjacent protective jacket to prevent heat and flame intrusion. The uppermost protective jacket has its upwardly directed toroidal opening 72 overlapping the intumescent epoxy 40*a* with the end of the intumescent epoxy being provided with the caulking compound 52 as shown in FIG. 6. The lower protective jacket 60 is also provided with an additional stepped portion forming a downwardly directed toroidal opening 76 to overlap the top end of the intumescent epoxy 40*b* as shown in FIG. 7. The top end of the intumescent epoxy 40*b* is caulked with caulking compound 52. It is to be understood that in those applications where the intumescent epoxy does not apply, the protective jackets may not need the toroidal openings 72 and 76 used to accomodate the intumescent epoxy.

Although not shown in FIGS. 1 and 3, FIGS. 4 and 8 show that each protective jacket 60 is preferably provided with a plurality of tabs 80 with eyelets 82 which are suitably attached, preferably by sewing, on the outer section 62 and are evenly distributed circumferentially of the protective jackets to mate with similarly sewn tabs 80 on an adjacent protective jacket 60 when assembled on a top joint 14 so that each tab can be fastened, as by lacing or strapping, by strings 84 circumferentially for holding the jackets together. Strings 84 are of the same materials as the outer section. Only the outer layer of section 62 is involved in the attachment of the tabs thus preventing entry of flame or heat into the interior blanket material 64.

Finally, as shown in FIGS. 3 and 4, the stepped seams 70 are offset to aid in the prevention of flame and heat intrusion as shown in FIG. 4 a suitable number of circumferential straps 50, of the same material as the outer section layers, surround the protective jackets to additionally maintain the protective jackets positioned on the threads 54.

From the foregoing, it can be seen that a fire protection system is installed over a top joint having means to facilitate the connection of a tensioner ring to the top joint by the steps of:

covering the tensioner ring with a flexible flame protective cover after connecting the tensioner ring onto the threads of a top joint, coating the top joint above and below with an intumescent epoxy, caulking the ends of the intumescent epoxy with a fire resistant compound, installing a selected number of protective jackets both above and below the tensioner ring and its protective cover with the top protective jacket overlapping the end of the intumescent epoxy above the threads and with the bottom protective jacket below the tensioner ring and its cover overlapping the top of the coating of intumescent epoxy below the threads, and fastening the protective jackets to each other and to the tensioner ring cover.

Alternatively, a fire protective system is installed over a top joint having means to facilitate the connection of a tensioner ring to the top joint without the use of intumescent epoxy by the steps of:

covering the tensioner ring with a flexible flame protective cover after the connecting tensioner ring onto the threads of the top joint, installing a selected number of protective jackets with above and below the tensioner ring and its protective cover so that the entire top joint is protected against fire, and fastening the protective jackets to each other and to the tensioner ring cover.

Having thus described the protection of the top joint in a marine riser tensioner system, attention is now directed to FIGS. 10 through 13 which schematically illustrate using the protective jackets 60 and 60*a* to protect the riser sections themselves.

Figure 10:
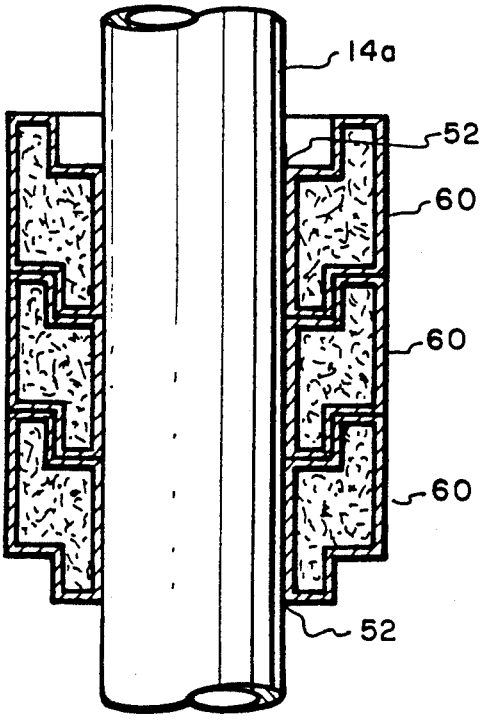
FIG. 10 illustrates the protective jackets positioned on a riser.

FIG. 10 shows three protective jackets 60 as a representative number on a marine riser section 14*a* with suitable caulking 52 which is applied for the reason mentioned previously.

Figure 11:
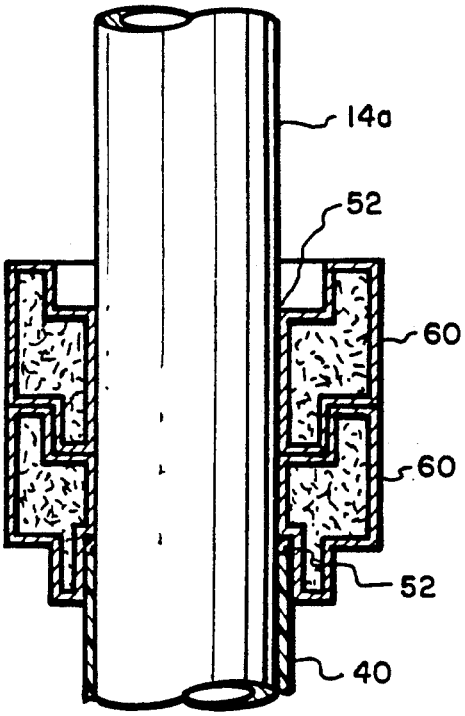
FIG. 11 is similar to FIG. 10 but shows one riser cooperating with the intumescent epoxy.

FIG. 11 shows a marine riser section 14*a* partially protected by intumescent epoxy 40 with two protective jackets 60 as a representative number and suitable caulking 52.

Figure 12:
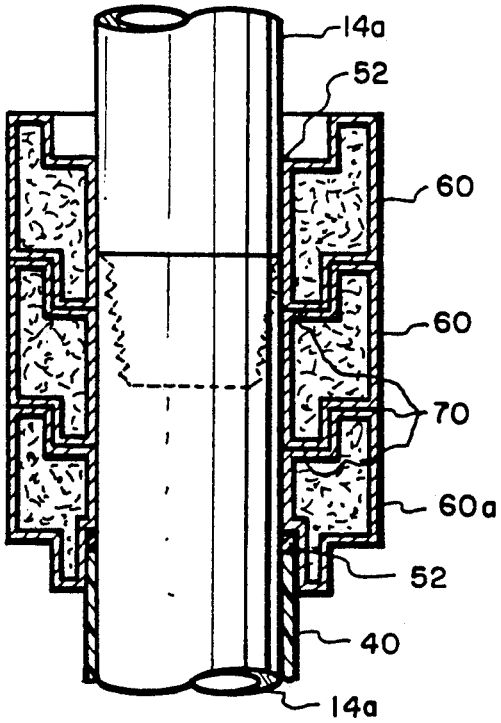
FIG. 12 illustrates the protective jackets extending over a threaded riser joint and also cooperating with the intumescent epoxy.

FIG. 12 shows two marine riser sections 14*a*, one of which is partially protected with intumescent epoxy 40 and one short protective jacket 60*a* cooperating therewith and two protective jackets 60. This FIG. illustrates how the protective jackets may be used to protect a threaded connector joint 70 between riser sections. As usual, suitable caulking 52 is used where appropriate.

Figure 13:
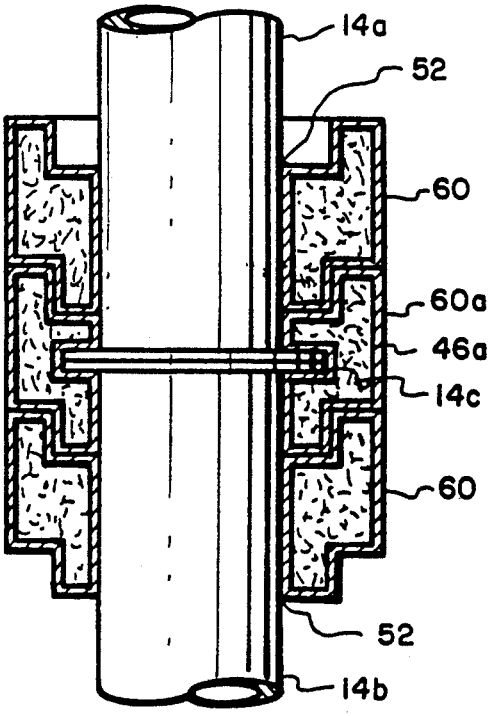
FIG. 13 illustrates flanged pipe connecting joints and the manner of protecting the flanges.

FIG. 13 illustrates two riser sections 14*a* of the flanged type with a protective cover 46*a* around the flanges and bolts holding the flanges together. Protective cover 46*a* is similar to the protective cover around the tensioner ring in FIG. 1 and for that reason was given a similar reference numeral. As usual, suitable caulking 52 is used where appropriate.

The protective jackets 60 and 60*a* are fastened to each other by strapping or lacing as discussed above in connection with the top joint 14 and where the protective cover 46*a* is used, these protective jackets are also fastened in a similar manner to this protective cover 46*a*.

From the foregoing, it can be seen that a fire protection system is installed over one or more marine riser sections by the steps of:

covering the marine riser sections with a selected number of protective jackets, and fastening the protective jackets to each other.

The fire protection system may further include short protective jackets or regular protective jackets to cooperate with intumescent epoxy. Additionally, suitable caulking is used where necessary to prevent flame intrusion.

We claim:

1. In a riser tensioner system of an offshore oil or gas rig including a plurality of pneumatic-hydraulic type cylinders with cylinder rods which extend from a rig platform to a top joint of a riser string to maintain the riser string in tension during vertical movement of the rig and in which the top joint is provided with means for facilitating the connection of a tensioner ring and cylinder rods to said top joint, the improvement in the system which comprises, a plurality of protective jackets surrounding said means for facilitating the connection both above and below said tensioner ring, each of said protective jackets comprising outer covering means with a thick interior multi-layered composite blanket of ceramic fiber materials and barrier films to prevent the transfer of heat to said top joint.

2. The system as claimed in claim 1 wherein said means for facilitating the connection of said tensioner ring comprises threads or annular protrusions.

3. The system as claimed in claim 2 in which said top joint is coated with a intumescent epoxy above and below said threads or annular protrusions and wherein said protective jackets overlap the ends of said intumescent epoxy.

4. The system as claimed in claim 3 wherein the ends of said intumescent epoxy are each provided with a flame resistant compound where said protective jackets overlap said intumescent epoxy to prevent the intrusion of heat and flame beneath said protective jackets.

5. The system as claimed in claim 4 wherein each protective jacket is provided with a toroidal opening and a toroidal tongue so that said toroidal opening receives the toroidal tongue of an adjacent protective jacket so that said protective jackets are nested.

6. The system as claimed in claim 5 wherein each protective jacket has a vertical seam which is displaced from a vertical seam of an adjacent protective jacket when said protective jackets are disposed on said top joint.

7. The system as claimed in claim 6 wherein said protective jackets are laced to one another to aid in maintaining the protective jackets on said top joint.

8. The system as claimed in claim 7 further including strapping means around each protective jacket.

9. A method of fire protecting a marine riser system for an offshore rig including pneumatic hydraulic cylinders connected between said rig and a riser string by a tensioner ring connected to a top joint of said riser string, said top joint having means for facilitating the connection of said tensioner ring to said top joint and wherein said tensioner ring is protected against heat and flame by a multi-layer protective cover, including the steps for protecting said means for facilitating said connection on said top joint comprising, coating the top joint above and below said means for facilitating the connection of said tensioner ring to said top joint, installing a selected number of protective jackets both above and below said tensioner ring and its protective cover with a top protective jacket overlapping the end of the intumescent epoxy and with the bottom protective jacket overlapping the top of the intumescent epoxy, and fastening said protective jackets to said top joint, to each other and to said tensioner ring cover.

10. In a riser tensioner system of an offshore oil or gas rig including a plurality of pneumatic-hydraulic type cylinders with cylinder rods which extend from a rig platform to a tensioner ring on a top joint of a riser string to maintain the riser string in tension during vertical movement of the rig, the improvement in the system which comprises, a plurality of protective jackets surrounding said top joint both above and below said tensioner ring, each of said protective jackets comprising outer covering means with a thick interior multi-layered composite blanket of ceramic fiber materials and barrier films to prevent the transfer of heat to said top joint.

11. A method of fire protecting a marine riser system for an offshore rig including pneumatic-hydraulic cylinders connected between said rig and a riser string wherein said tensioner ring is protected against heat and flame by a multi-layered protective cover, including the steps of, installing a selected number of nestable protective jackets both above and below said tensioner ring and its protective cover and, fastening said protective jackets to said top joint, to each other and to said tensioner ring cover.

12. In a riser tensioner system of an offshore oil or gas rig including a plurality of pneumatic-hydraulic type cylinders with cylinder rods which extend from a rig platform to a plurality of riser sections to maintain said riser sections in tension during vertical movement of the rig, the improvement in the system comprising, a plurality of protective jackets surrounding one or more of said riser sections, each of said protective jackets comprising outer covering means with a thick interior multi-layered composite blanket of ceramic fiber materials and barrier films to prevent the transfer of heat to said protected riser sections.

13. In a riser system of an offshore oil or gas rig including a plurality of riser sections which extend from a rig platform to a subsea well, the improvement in the system including, a plurality of protective jackets surrounding one of more of said riser sections, each of said protective jackets comprising an outer covering means with a thick interior composite blanket of ceramic fiber and barrier films to prevent the transfer of heat to said protective riser sections.

* * * * *